US006774784B2

(12) United States Patent
Satoh

(10) Patent No.: US 6,774,784 B2
(45) Date of Patent: Aug. 10, 2004

(54) EMERGENCY NOTIFICATION SYSTEM FOR NOTIFYING A PREDETERMINED CONTACT INFORMATION OF AN EMERGENCY SITUATION

(75) Inventor: Kazuhiko Satoh, Tokyo (JP)

(73) Assignee: Allied Telesis K.K., Tokyo (JP)

( * ) Notice: Subject to any disclaimer, the term of this patent is extended or adjusted under 35 U.S.C. 154(b) by 160 days.

(21) Appl. No.: 10/109,556

(22) Filed: Mar. 28, 2002

(65) Prior Publication Data

US 2003/0102973 A1 Jun. 5, 2003

(30) Foreign Application Priority Data

Dec. 4, 2001 (JP) ..... 2001-370420

(51) Int. Cl.[7] ..... G08B 29/00

(52) U.S. Cl. ..... 340/506; 340/286.06; 340/505; 340/3.1; 379/38

(58) Field of Search ..... 340/286.06, 505, 340/506, 692, 3.1, 3.52, 5.6, 5.81, 10.52; 379/38, 40, 41, 88.01, 106.01; 235/38, 380

(56) References Cited

U.S. PATENT DOCUMENTS 5,878,134 A * 3/1999 Handelman et al. ..... 340/5.6
6,014,346 A * 1/2000 Malone ..... 368/10
6,122,351 A * 9/2000 Schlueter et al. ..... 379/106.02
6,388,558 B1 * 5/2002 Emmei ..... 340/5.2
6,496,111 B1 * 12/2002 Hosack ..... 340/540

* cited by examiner

*Primary Examiner*—Daniel J. Wu
*Assistant Examiner*—Phung Nguyen
(74) *Attorney, Agent, or Firm*—Osha & May L.L.P.

(57) ABSTRACT

When an IC card 1 is inserted into an IC card reader 2 of an emergency notification box 101, the name and so on of an aged person are read to be inputted to a controlling section 4, and this information is sent out as an emergency notification signal from a communication section 6 by a controlling section 4 via a public telephone line 7 to a receiving device 102 of a place to be contacted which is stored in advance. In the receiving section 102, the name and so on of an aged person is outputted from a speaker 12, and furthermore, a warning light 13 is lighted and a vibrator 14 is vibrated to notify an emergency.

6 Claims, 3 Drawing Sheets

EMERGENCY NOTIFICATION SYSTEM FOR NOTIFYING A PREDETERMINED CONTACT INFORMATION OF AN EMERGENCY SITUATION

BACKGROUND OF THE INVENTION

1. Field of the Invention

The present invention relates to a system in which an emergency occurrence inside a house of an aged person is notified to the outside, and particularly, to a system which realizes improvement in quickness, sureness, and so on.

2. Description of the Related Art

Japan has seen a gradual increase in a ratio of, what is called, an elderly population to the total population, this elderly population ratio exceeding a ratio of those except aged people to the total population, and this has presented indication that a so-called aging society is actually coming at hand year by year.

In view of this social situation, various kinds of services for supporting the lives of aged people have recently been practiced on various levels, such as on a governmental level, a non-governmental level, and so on.

Specifically, a so-called visiting service is one of the examples. In this service, patrolling staff regularly visit aged people who live alone to give advice to them on their worries and inconveniences and to make sure that nothing is wrong with the lives of the aged people.

However, it is often difficult to secure a sufficient number of patrolling staff members in the services like the above due to various reasons. Moreover, while this shortage of the staff is a general tendency, the number of aged people requiring these services is on the increase. Under these conditions, it is difficult to provide sufficient services to them.

There also exists a problem that consideration should be fully given to privacy protection of aged people in view of the basic nature of the visiting services mentioned above that the patrolling staff actually visit the houses of the aged people.

Furthermore, especially, an aged person who lives alone and the like often has difficulty in getting in contact with a medical institution or making an emergency call for an ambulance when he/she is suddenly taken ill. Moreover, even if he/she manages to make a call, the line of the other party may be busy, and in such a case, such a situation may occur that he/she has difficulty even in calling again. Furthermore, even if he/she can reach the other party, such a situation may also occur that it is difficult for an appropriate and quick measure to be taken since he/she cannot talk well enough to make the other party understand him/her.

SUMMARY OF THE INVENTION

It is an object of the present invention to provide a supporting system for aged people using an IC card, an emergency notification box, and a receiving device which are able to support aged people in leading smooth lives while securing their privacy.

It is another object of the present invention to provide a supporting system for aged people using an IC card, an emergency notification box, and a receiving device which realize quick and sure notification of an emergency occurrence in houses of aged people to nearest institutions concerned.

According to a first aspect of the present invention, provided is a supporting system for aged people using an IC card, comprising:

an emergency notification box for reading information on an IC card and sending out the information as an emergency notification signal to an external part via a public telephone line; and a receiving device for receiving the emergency notification signal sent out from the emergency notification box via the public telephone line and performing notification processing.

In the configuration as described above, the IC card is inserted into the emergency notification box so that a signal for automatically notifying an emergency is sent out to the receiving device disposed in the external part. Thereby, an emergency occurrence in a house of an aged person can be quickly and surely notified to a nearest institution concerned while privacy of the aged person is secured.

According to a second aspect of the present invention, provided is an emergency notification box, comprising:

an IC card reader for reading information on an inserted IC card;

a controlling section for processing the information on the IC card which is obtained by the IC card reader to enable the information to be sent out to a notification destination stored in advance by including the information in a predetermined emergency notification signal; and a communication section for sending out the emergency notification signal outputted by the controlling section via a public telephone line.

According to a third aspect of the present invention, provided is a receiving device which is structured to extract necessary information from an emergency notification signal and notify the extracted information to a user, when the emergency notification signal is inputted via a public telephone line.

DETAILED DESCRIPTION OF THE PREFERRED EMBODIMENTS

The present invention will be hereinafter described in detail with reference to the attached drawings.

Incidentally, it is to be understood that the present invention is not intended to be limited to members, dispositions, and so forth which will be described below, and various modifications and improvements may be made therein without departing from the spirit of the present invention.

Figure 1:
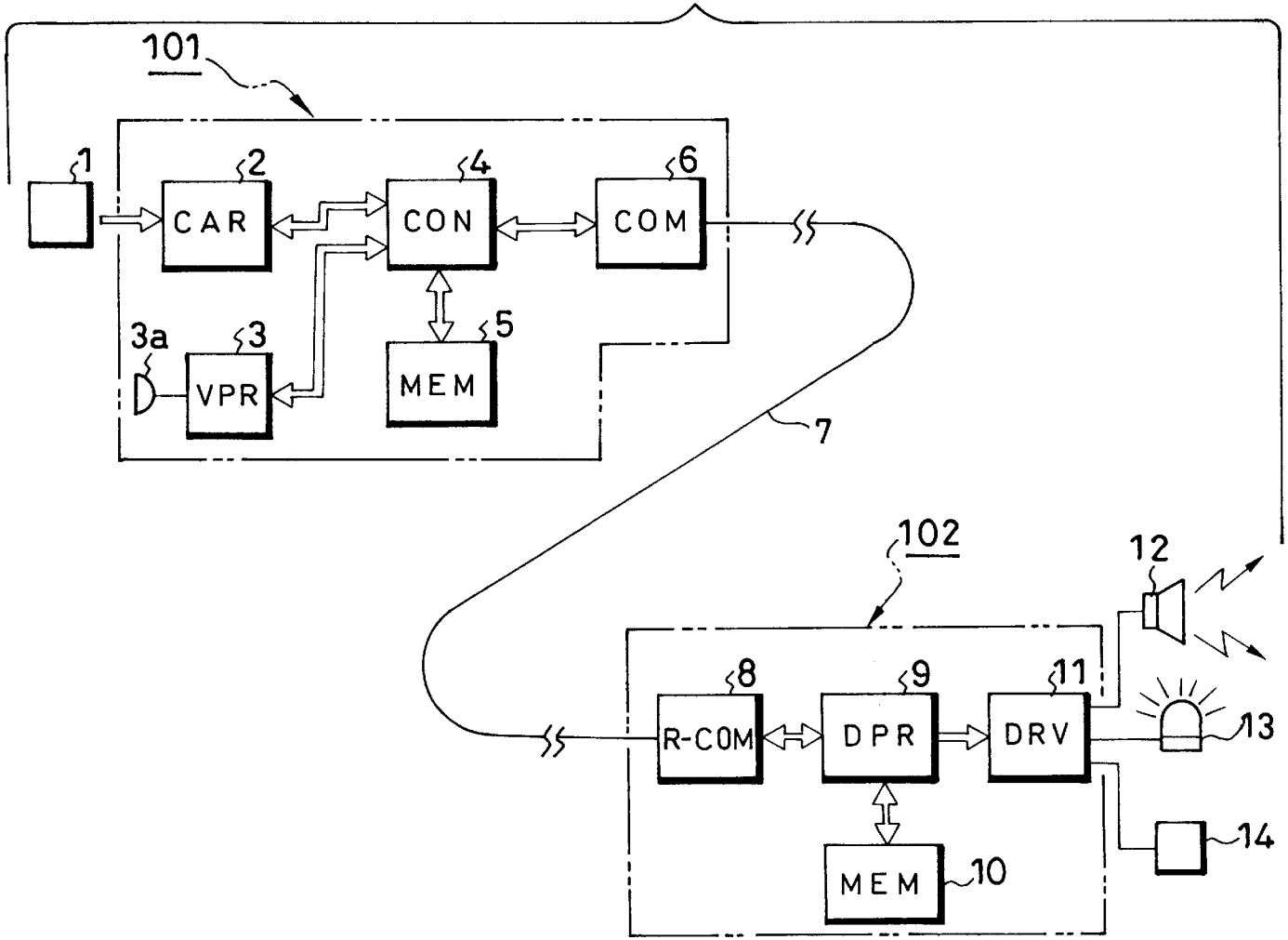
FIG. 1 is a block diagram showing a configuration example of a supporting system for aged people using an IC card in an embodiment of the present invention.

First, a configuration example of a supporting system for aged people using an IC card in an embodiment of the present invention is explained with reference to FIG. 1.

The supporting system for aged people using an IC card in the embodiment of the present invention is composed of an emergency notification box 101 and a receiving device 102 as its main components.

An emergency notification box 101 is installed in a house of an aged person and a receiving device 102 is installed in a nearest medical institution, a firehouse, a house of his/her relative, a neighboring house, and so on. Incidentally, a configuration in which only one receiving device 102 is disposed is shown in FIG. 1. However, this configuration is given only to make the configuration easy to understand and in actual usage, it is preferable to dispose it in a plurality of places as those mentioned above.

Each of the components constituting the supporting system for aged people using an IC card in the embodiment of the present invention will be specifically explained below.

First, an emergency notification box 101 in the embodiment of the present invention is composed of an IC card reader (denoted by 'CAR' in FIG. 1) 2, a voice processing section (denoted by 'VPR' in FIG. 1) 3, a controlling section (denoted by 'CON' in FIG. 1) 4, a memory section (denoted by 'MEM' in FIG. 1) 5, and a communication section (denoted by 'COM' in FIG. 1) 6 as its main components and they are accommodated in one case (not shown).

The IC card reader 2 is a component for reading various information stored on an IC card 1 and inputting the read information to the controlling section 4, and it has a generally and conventionally known structure. Incidentally, a so-called contact type and non-contact type are available as a method of reading data on an IC card 1 by this IC card reader 2 and either one of them may be applied in the embodiment of the present invention.

On the IC card 1 mentioned here, personal information on the aged person is stored and this IC card 1 is inserted into a predetermined place of the emergency notification box 101 described later in a case of emergency so that a notification operation of an emergency notification box 101 is started to notify the emergency to an appropriate place to be contacted.

In the embodiment of the present invention, the IC card 1 includes, specifically, a smart card, an intelligent card, a chip-in card, a microcircuit (microcomputer) card, a memory card, a medium extended card (super card), a multi-function card, a combination card, and the like having a generally and conventionally known structure. Its shape need not be limited to the shape of a so-called card-type medium, and may be in any shape, for example, it may be an ultra-small type which is as small as a stamp or smaller than that and have a shape of a coin or the like. It may also use a member such as a looped string so that the aged person can hang it around his/her neck to carry it with him/her all the time.

It is preferable that medical information such as his/her blood type, medical history, and allergy to medicine is also included in the personal information of the aged person stored in advance on the aforesaid IC card 1 in addition to information for identifying the aged person, for example, the name, address, and so on of the aged person.

The voice processing section 3 which serves as a voice inputting means is a component for sending out information given by the aged person by means of his/her voice and the IC card 1 or by means of a voice instead of the IC card 1 to a predetermined place which is designated in advance as a place to be contacted in a case of emergency (a notification destination). To be more specific, the voice processing section 3, which is connected to a microphone 3*a*, is structured to convert a voice uttered by the aged person into a digital aural signal when the voice is inputted thereto via a microphone 3*a*, and to input the voice to the controlling section 4 after converting it into a form appropriate for transmission to the receiving device 102.

The controlling section 4 controls the whole operation of this emergency notification box 101 and it also performs emergency notification processing as described later.

In the memory section 5, a program for the emergency notification processing which is executed in a controlling section 4 is stored in advance, and also stored in advance are telephone numbers of notification destinations such as a nearest medical institution, a firehouse, a house of his/her relative, a neighboring house, and so on to which the emergency is notified by an emergency notification box 101 as described later, various data required for the operation control, and so on.

The communication section 6 is connected to, for example, a public telephone line 7, and is structured to transmit the emergency notification signal, which is outputted by the controlling section 4, to the receiving device 102 as described later.

In the embodiment of the present invention, a controlling section 4, a memory section 5, and a communication section 6 constitute an interconnecting device. To specify such an interconnecting device, a hub, a switch, a router, other concentrators, a repeater, a bridge, a gateway device, a PC, a server, and an wireless interconnecting device (for example, an interconnecting device of a wireless LAN which is generally called an access point) are available. Therefore, an emergency notification box 101 in the embodiment of the present invention can be defined as being structured by adding an IC card reader 2 and the voice processing section 3, which are previously described, to an interconnecting device such as a hub and so on having a generally and conventionally known structure and as being provided in its controlling section 4 with a function of operation control over the hub and so on and in addition, with a function of operation control over an IC card reader 2 and a voice processing section 3 and a later described emergency notification processing function.

Meanwhile, a receiving device 102 is composed of a receiving-side communication section (denoted by 'R-COM' in FIG. 1) 8, a data processing section (denoted by 'DPR' in FIG. 1) 9, a memory section (denoted by 'MEM' in FIG. 1) 10, a driving section (denoted by 'DRV' in FIG. 1) 11, a speaker 12 serving as a warning device, a warning light 13, and a vibrator 14 as its main components.

The receiving-side communication section 8 is structured to receive the emergency notification signal sent out from an emergency notification box 101 via a public telephone line 7 and converts this signal to a signal form appropriate for processing performed in a data processing section 9 to output it to a data processing section 9, and it serves as, what is called, interfacing a public telephone line 7 and a data processing section 9.

A data processing section 9 is structured to cause the speaker 12 to sound, the warning light 13 to light, and the vibrator 14 to vibrate via the driving section 11 based on the emergency notification signal inputted via the receiving-side communication section 8.

A driving section 11 drives the speaker 12, the warning light 13, and the vibrator 14 according to the signal outputted from a data processing section 9 as described above.

Next, the operation in the configuration as described above will be explained with reference to subroutine flow charts shown in FIG. 2 and FIG. 3.

An emergency notification processing executed in the emergency notification box 101 will be first explained with reference to the subroutine flow chart shown in FIG. 2.

Figure 2:
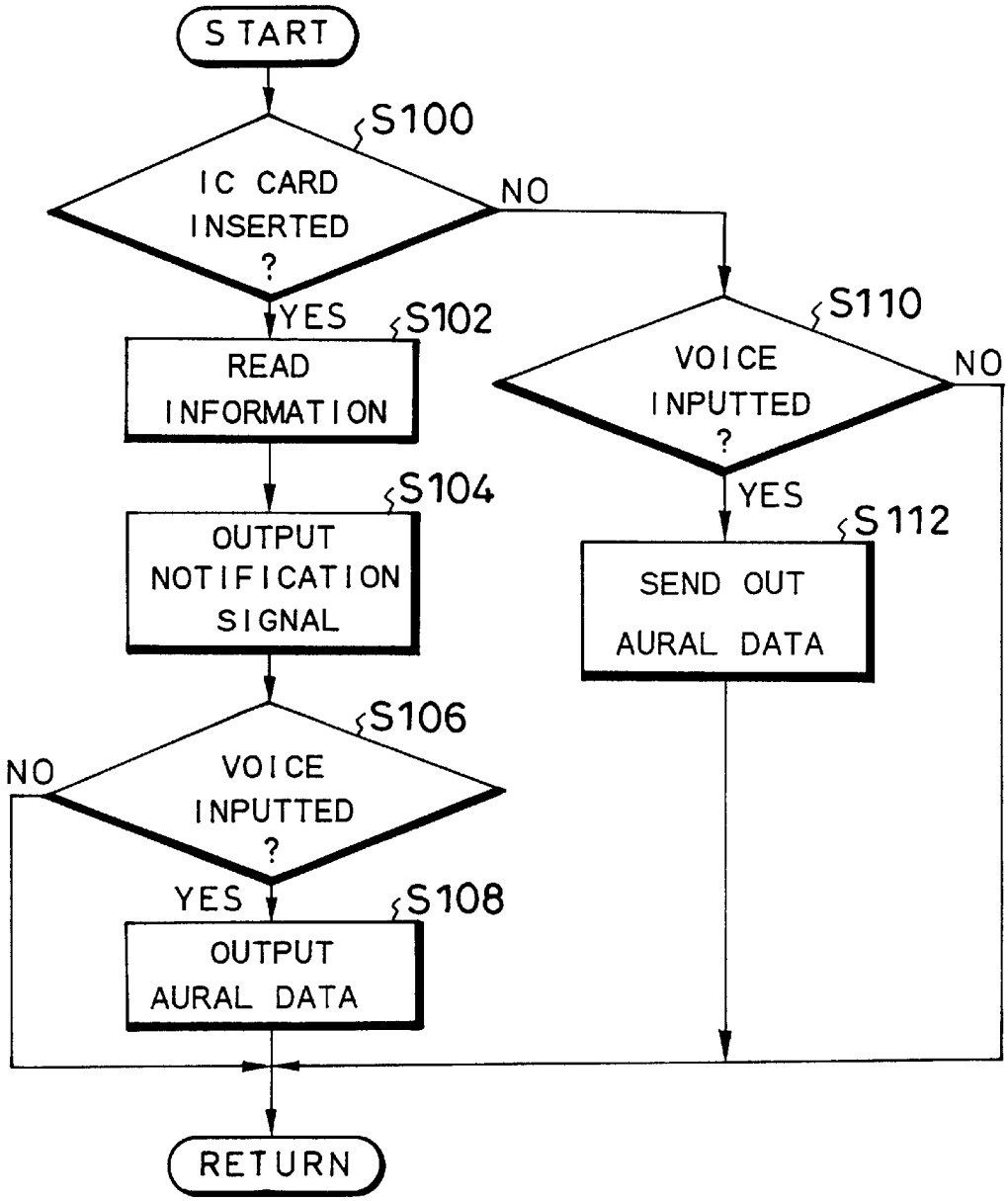
FIG. 2 is a subroutine flow chart showing a procedure for emergency notification processing executed by an emergency notification box in the embodiment of the present invention.

When the processing is started, it is first judged whether or not an IC card 1 is inserted into an IC card reader 2 (refer to Step S100 in FIG. 2). Specifically, when an aged person inserts an IC card 1 into this IC card reader 2 since he/she feels a bad physical condition or the like and wants to urgently get in contact with a medical institution and so on, this insertion of an IC card 1 is detected in this IC card reader 2 so that its detection signal is inputted to a controlling section 4. Then, it is judged in a controlling section 4 whether or not an IC card 1 is inserted based on the existence and nonexistence of the detection signal from this IC card reader 2.

When it is judged in Step S100 that the IC card 1 is inserted (in a case of YES), the procedure proceeds to processing in Step S102 described next, while the procedure proceeds to later described processing in Step S110 when it is judged that this IC card 1 is not inserted into an IC card reader 2 (in a case of NO).

The personal information on an aged person stored on this IC card 1 is read by an IC card reader 2 in Step S102 and the read personal information is inputted to the controlling section 4.

Then, in the controlling section 4, a message to the effect that an emergency has occurred and the aforesaid personal information are sent out as the emergency notification signal via a communication section 6 to places to be contacted which are stored in a memory section 5 in advance, namely, telephone numbers of a nearest medical institution, a firehouse, a house of his/her relative, a neighboring house, and so on (refer to Step S104 in FIG. 2).

Thereafter, it is judged whether or not a voice is inputted (refer to Step S106 in FIG. 2). Specifically, when an aged person utters a voice to the emergency notification box 101, a voice is collected by a microphone 3*a* disposed in an emergency notification box 101, and at this time, a voice processing section 3 notifies a controlling section 4 by a predetermined signal that a voice is inputted. This enables the controlling section 4 to judge whether or not a voice is inputted based on whether or not a predetermined signal corresponding to a voice input is inputted from this voice processing section 3.

Then, when it is judged in Step S106 that the voice is inputted (in a case of YES), the voice collected by a microphone 3*a* is converted to a digital signal by a voice processing section 3 and also converted to a predetermined transmission form appropriate for signal transmission via a public telephone line 7 to be inputted to a controlling section 4. In a controlling section 4, timing for signal transmission via a communication section 6 is adjusted and aural data is sent out to a public telephone line 7 via a communication section 6 to be sent to a receiving device 102 (refer to Step 108 in FIG. 2). Incidentally, after this processing in Step S108, the procedure once returns to a not-shown main routine, where other processing is executed, and thereafter, this subroutine processing is repeated again.

Meanwhile, when it is judged in Step S106 that a voice is not inputted (in a case of NO), this subroutine processing is finished without a processing in Step S108 described above being executed Meanwhile, when it is judged in Step S100 previously explained that an IC card 1 is not inserted and the procedure proceeds to Step S110, it is judged whether or not a voice is inputted. In other words, this judgment whether or not a voice is inputted is made in order to detect a voice which is inputted, for example, when the aged person want notifies an emergency to a nearest medical institution and so on by means of his/her voice due to his difficulty in inserting this IC card 1 into an IC card reader 2 of the emergency notification box 101 and other reasons.

Then, when it is judged in this Step S110 that the voice is not inputted (in a case of NO), a series of this subroutine processing is finished, while a voice which is collected by a microphone 3*a* is sent out in a similar manner to that explained in the processing in the previous Step S108 (refer to Step S112 in FIG. 2) to finish the series of a subroutine processing when it is judged that a voice is inputted (in a case of YES).

Incidentally, especially when a voice of an aged person is inputted without the insertion of the IC card 1, it is preferable that a personal information such as the name of an aged person (or a predetermined code or a like for specifying and identifying an aged person) which is stored in a controlling section 4 or a memory section 5 in advance is sent out as a digital aural signal in this Step S112, considering a case where an aged person manages to utter a voice with great difficulty.

Next, the operation of the receiving device 102 will be explained with reference to a subroutine flow chart shown in FIG. 3.

Figure 3:
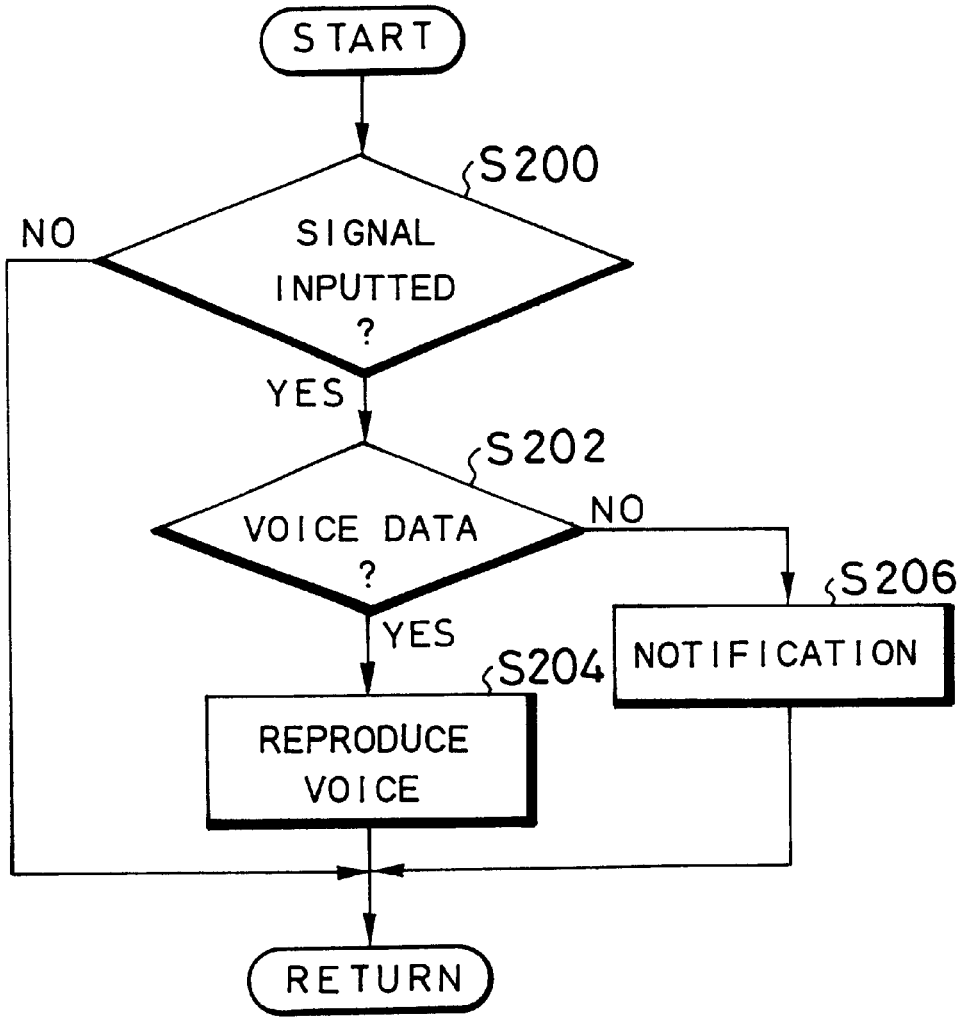
FIG. 3 is a subroutine flow chart showing a processing procedure when an emergency notification signal is received in a receiving device in the embodiment of the present invention.

When the processing by the data processing section 9 is started, it is first judged whether or not a signal is inputted from the outside via the receiving-side communication section 8 (refer to Step S200 in FIG. 3). When it is judged that the signal is not inputted (in a case of NO), a series of this subroutine processing is finished and the procedure once returns to a not-shown main routine, where other processing is executed, and thereafter, this subroutine processing is repeated again. Meanwhile, when it is judged in Step S200 that the signal is inputted (in a case of YES), it is judged whether or not a inputted signal is an aural data (refer to Step S202 in FIG. 3).

Then, when it is judged in Step S202 that this inputted signal is an aural data (in a case of YES), the data processing section 9 executes processing for having the speaker 12 reproduce and an output digital aural data and thereafter, this aural data is supplied to the speaker 12 via the driving section 11 (refer to Step S204 in FIG. 3) so that a user of the receiving device 102 can hear the content of what the aged person talked in front of an emergency notification box 101. After this processing in Step S204 is executed, the procedure once returns to the not-shown main routine, where other processing is executed, and thereafter, this subroutine processing is repeated again.

Incidentally, as explained previously in Step S112 in FIG. 2, when a predetermined digital aural signal is sent out from an emergency notification box 101, it is preferable that in Step S204 explained above, this predetermined digital aural signal is reproduced and predetermined content (for example, the personal information such as the name of an aged person) is outputted from the speaker 12, considering the case where an aged person cannot talk sufficiently.

Meanwhile, when it is judged in Step S202 that the inputted signal is not an aural data (in a case of NO), which signifies that a inputted signal is an emergency notification signal generated by the insertion of the IC card 1 into an emergency notification box 101, notification processing is executed (refer to Step S206 in FIG. 3). To summarize, according to this configuration example, in the data processing section 9, the predetermined message included in the received emergency notification signal first undergoes reproduction processing for enabling the message to be outputted to the speaker 12 via the driving section 11, and the message is outputted by the speaker 12. This predetermined message may take any form, for example, "An emergency has occurred to A (the name of an aged person) in XX town", as long as it can at least specify the aged person to whom the emergency has occurred, and its content need not be limited to a specific one. Moreover, the medical information (for example, his/her blood type and so on) read from the IC card 1 is also outputted from the speaker 12 by means of an electrically generated voice.

At the same time, the warning light 13 is lighted and the vibrator 14 is vibrated by the data processing section 9 via the driving section 11 so that the emergency occurrence is notified to the user of the receiving device 102.

Incidentally, the speaker 12, the warning light 13, and the vibrator 14 execute an emergency notification in a configuration example in an embodiment of a present invention. However, all of the three are not of course required, and the configuration where either one of the three or a selective combination of them are provided is acceptable. Furthermore, in the configuration example of an embodiment of the present invention, a speaker 12, a warning light 13, and a vibrator 14 are cable-connected to the driving section 11. However, the configuration in which they are wirelessly connected is of course acceptable. Since this configuration is apparent to a so-called person skilled in the art, specific explanation thereof will be omitted here.

As described hitherto, according to the present invention, an emergency occurrence can be automatically notified to a nearest medical institution and so on by insertion of an IC card or by a voice, which brings about the effect that an emergency occurrence in a house of an aged person can be quickly and surely notified to nearest institutions concerned while securing privacy of an aged person.

Furthermore, the quick and sure notification of an emergency occurrence enables an appropriate measure to be taken without delay, which brings about the effect that safety in a life of an aged person can be secured and as a result, contribution can be given to a improvement in his/her living environment.

What is claimed is:

1. An emergency notification system for notifying a predetermined contact information of an emergency situation occurring in a home, using a public telephone line, the emergency notification system comprising:

an emergency notification box disposed in the home; and a receiving device disposed in a place of the predetermined contact information, connected to the emergency notification box via the public telephone line, wherein the emergency notification box comprising:

an interconnecting device for sending a predetermined signal to the receiving device via the public telephone line;

an IC card reader for reading the predetermined contact information stored in an IC card inserted therein;

a memory for storing a predetermined digital audio signal regarding personal information of a user and the predetermined contact information; and a voice detecting section for detecting a voice of the user, wherein the emergency notification box is structured to, if the IC card is inserted into the IC card reader, read the predetermined contact information from the IC card and send an emergency notification signal to the receiving device based on the predetermined contact information, and, if the IC card is not inserted into the IC card reader and the voice detecting section detects the voice of the user, send at least the digital audio signal regarding the personal information based on the predetermined contact information, and wherein the receiving device is structured to reproduce the digital audio signal sent from the emergency notification box.

2. The emergency notification system according to claim 1, the receiving device further comprising:

a plurality of warning devices; and a driving device for driving the plurality of warning devices respectively, wherein the receiving device is structured to, if receiving at least one of the predetermined signal other than the digital audio signal from the emergency notification box, selectively control at least one of the plurality of warning devices in accordance with the received signal.

3. The emergency notification system according to claim 2, wherein one of the plurality of warning devices is any one of a speaker, a warning light, and a vibrator.

4. A method of notifying an emergency situation occurring in a home of a user, using a public telephone line, the method comprising:

storing a predetermined contact information into a IC card to be owned by the user;

disposing an emergency notification box in the home, while disposing a receiving device in a place of the predetermined contact information, wherein the emergency notification box comprises an interconnecting device for sending a predetermined signal to the receiving device, an IC card reader for reading the predetermined contact information stored in the IC card, a memory for storing a predetermined digital audio signal regarding personal information of the user and the predetermined contact information, and a voice detecting section for detecting a voice of the user;

judging whether the IC card is inserted into the IC card reader, judging whether the voice detecting section detects the voice of the user if judged the IC card is not inserted into the IC card reader;

reading the predetermined contact information from the inserted IC card if judged the IC card is inserted, and sending an emergency notification signal to the receiving device;

reading the predetermined digital audio signal from the memory if judged the bare voice is detected, and sending the predetermined digital audio signal to the receiving device via the public telephone line; and issuing a warning based on the signal sent from the emergency notification box.

5. The method according to claim 3, wherein the issuing step reproduces the predetermined digital audio signal sent from the emergency notification box.

6. The method according to claim 3, wherein the receiving device comprises a plurality of warning devices, and drives at least one of the plurality of the warning devices based on the signal sent from the emergency notification box.

* * * * *